US005929365A

United States Patent [19]

Wilson et al.

[11] Patent Number: 5,929,365

[45] Date of Patent: Jul. 27, 1999

[54] SOLENOID SELECTOR SWITCH SHIELD FOR WEAPONS SYSTEM FEEDER ASSEMBLY

[76] Inventors: James H. Wilson, 291 Lewis Perkins Rd., Leesville, La. 71446; James M. Wilson, 5495 Highway 392, Anacoco, La. 71403

[21] Appl. No.: 09/050,553

[22] Filed: Mar. 30, 1998

Related U.S. Application Data

[60] Provisional application No. 60/040,896, Apr. 2, 1997.

[51] Int. Cl.[6] ..... F41A 9/00; H01F 7/00

[52] U.S. Cl. ..... 89/33.04; 335/278; 220/DIG. 21

[58] Field of Search ..... 89/33.04, 1.1; 335/278; 220/DIG. 21; 200/304, 333, 332.2, 302.3, 330, 552, 61.39, 61.85, 341; 267/145

[56] References Cited

U.S. PATENT DOCUMENTS 5,300,909 4/1994 Wilson ..... 335/278

*Primary Examiner*—Charles T. Jordan
*Assistant Examiner*—Jeff Howell
*Attorney, Agent, or Firm*—John M Harrison

[57] ABSTRACT

A solenoid selector switch shield for protecting the solenoid switch in a feeder assembly that feeds ammunition to a weapons system. The solenoid selector switch shield is designed to fit over the solenoid and the selector switch and prevent damage to the selector switch during both shipping and operation of the weapons system. In a preferred embodiment the solenoid selector switch shield is characterized by a cylindrical shield barrel having a bevelled access end and a mount end provided with an end mount bracket for mounting the shield to the feeder assembly. A middle bracket is also welded or otherwise attached to the shield barrel and is likewise secured to the feeder assembly. The bevelled access end of the shield barrel is designed to facilitate optimum access to the selector switch knob of the solenoid switch for manipulating the solenoid switch and determining the type of ammunition to be fed to the weapons system by the feeder assembly.

16 Claims, 1 Drawing Sheet

SOLENOID SELECTOR SWITCH SHIELD FOR WEAPONS SYSTEM FEEDER ASSEMBLY

CROSS-REFERENCE TO RELATED APPLICATION

This application claims the benefit of U.S. Provisional Application Ser. No. 60/040,896, filed Apr. 2, 1997.

BACKGROUND OF THE INVENTION

1. Field of the Invention

This invention relates to switch shields for weapons systems and more particularly, to a solenoid selector switch shield which is designed to protect the solenoid and solenoid selector switch attached to a feeder assembly for a weapons system such as the Bradley Fighting Vehicle 25 mm. cannon. The solenoid selector switch shield is designed to protect both the solenoid and the selector switch extending from the end of the solenoid, which selector switch may be manipulated with the solenoid selector switch shield in place to determine the type of ammunition fed to the cannon by the feeder assembly.

One of the problems which became apparent both in the shipping of feeder assemblies and in the use of the feeder assemblies on weapons systems such as cannons under battlefield conditions, was that of damaging the solenoid selector switch. When the selector switch is damaged, it cannot be effectively manipulated to determine the type of ammunition to be fired by the cannon and thus fed to the cannon by the feeder assembly. Accordingly, it became necessary to develop a means for shielding and protecting the solenoid selector switch from damage, both during shipment of the feeder assembly and during operation of the feeder assembly under field conditions.

2. Description of the Prior Art

My U.S. Pat. No. 5,300,909, details a selector switch shield which is mounted on the solenoid of a feeder assembly for protecting the solenoid selector switch during shipment of the feeder assembly. The device provides protection to the feeder solenoid during shipment of the feeder assembly and yet allows limited access to the solenoid and solenoid selector switch.

It is an object of this invention to provide a new and improved solenoid selector switch shield for mounting on weapons system feeder assembly solenoids in order to protect the solenoid and the selector switch extending from the solenoid from damage, both during shipment of the feeder assembly and under battlefield conditions.

Another object of the invention is to provide a solenoid selector switch shield which is designed to mount on the feeder assembly of a weapons system such as the Bradley Fighting Vehicle 25 mm. Cannon and is characterized by a cylindrical shield barrel having an improved access end a barrel and bracket design which provides adequate clearance between the shield barrel and the gun turret or feeder housing when the barrel of the gun is being elevated under field conditions.

Still another object of this invention is to provide a solenoid selector switch shield which is mounted on the feeder assembly of a weapons system and shields the solenoid and the selector switch extending from the solenoid, wherein the shield barrel is modified to facilitate sufficient clearance between the shield barrel and the feeder assembly under operating conditions.

Yet another object of this invention is to provide a new and improved solenoid selector switch shield having an improved and optimized access end bevel to facilitate optimum access to the selector solenoid knob shielded by the shield barrel.

A still further object of the invention is to provide a solenoid selector switch shield for shielding a solenoid and solenoid selector switch on the feeder assembly of a weapons system, which shield includes a modified shaft plate to effect more clearance between the shaft plate and the selector solenoid switch knob, thereby further protecting the solenoid switch knob while allowing optimum access to the selector switch knob for manipulation thereof during operation of the feeder assembly.

SUMMARY OF THE INVENTION

These and other objects of the invention are provided in a new and improved solenoid selector switch shield for shielding both the solenoid and the solenoid selector switch extending from the solenoid in the feeder or gun turret assembly of a weapons system. In a preferred embodiment the solenoid selector switch shield is characterized by a shield barrel having an improved, optimum access end bevel and optionally curved shaft plate to facilitate better access to the selector switch knob extending from the end of the solenoid. The shield barrel radius has also been decreased and lowered to decrease the profile thereof and facilitate better clearance between the shield barrel and the elements of the feeder assembly surrounding the solenoid during operation of the weapons system.

BRIEF DESCRIPTION OF THE DRAWINGS

The invention will be better understood by reference to the accompanying drawing, wherein.

DESCRIPTION OF THE PREFERRED EMBODIMENTS

Figure 1:
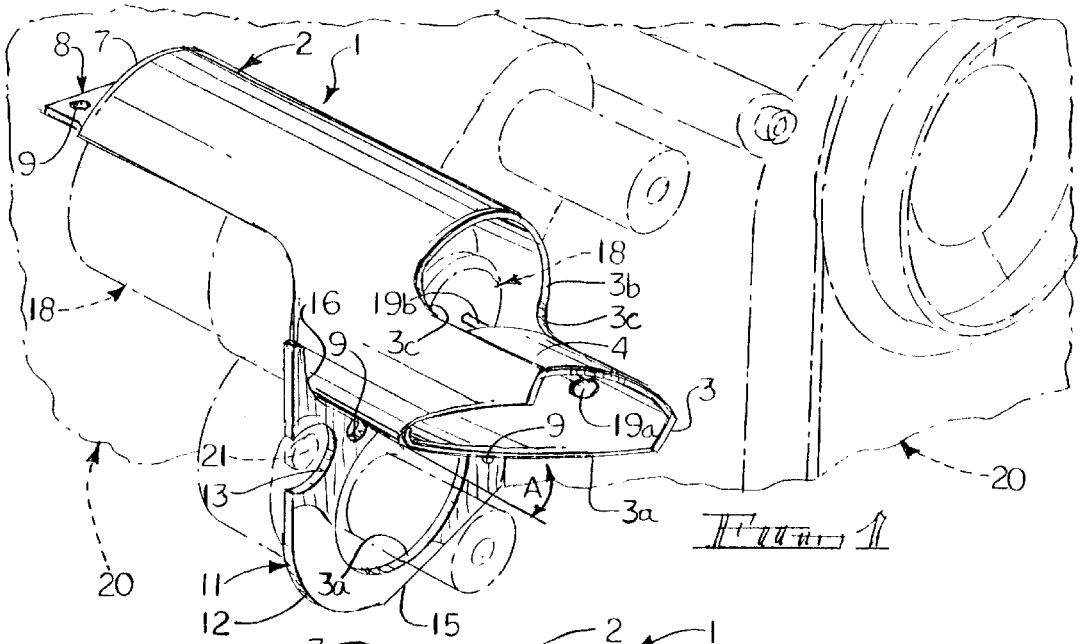
FIG. 1 is a perspective view of a preferred embodiment of the solenoid selector switch shield of this invention.

Referring to FIGS. 1–4 of the drawing, in a preferred embodiment the solenoid selector switch shield of this invention is generally illustrated by reference numeral 1. The solenoid selector switch shield 1 is characterized by a tubular shield barrel 2, having an access end 3, provided with an access end bevel 3*a*. A curved shaft plate 4 extends across the access end 3 of the shield barrel 2 spanning the access end slot 3*b* and the curvature of the shaft plate 4 is designed, along with the access end bevel 3*a*, to provide optimum access to the selector switch knob 19*a* of the selector switch 19 shielded by the shield barrel 2, as illustrated in FIG. 1. The selector switch 19 extends from the end of a solenoid 18, which is illustrated in phantom in FIG. 1 and is also shielded by the shield barrel 2 of the solenoid selector switch shield 1. The shield barrel 2 is further characterized by a mount end 7, fitted with a mount end bracket 8, having mount openings 9 for receiving bolts or cap screws (not illustrated) and mounting the mount end 7 of the shield barrel 2 to the feeder assembly 20, which receives the solenoid 18, as further illustrated in FIG. 1.

Figure 2:
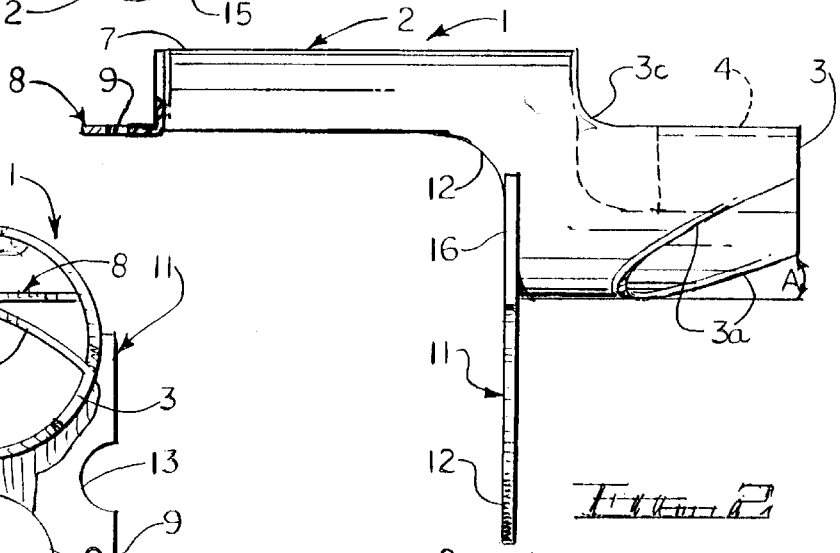
FIG. 2 is a side view of the solenoid selector switch shield illustrated in FIG. 1.
Figure 3:
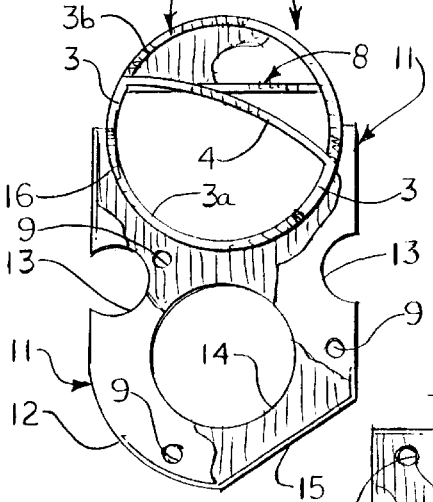
FIG. 3 is an access end view of the solenoid selector switch shield illustrated in FIGS. 1 and 2.
Figure 4:
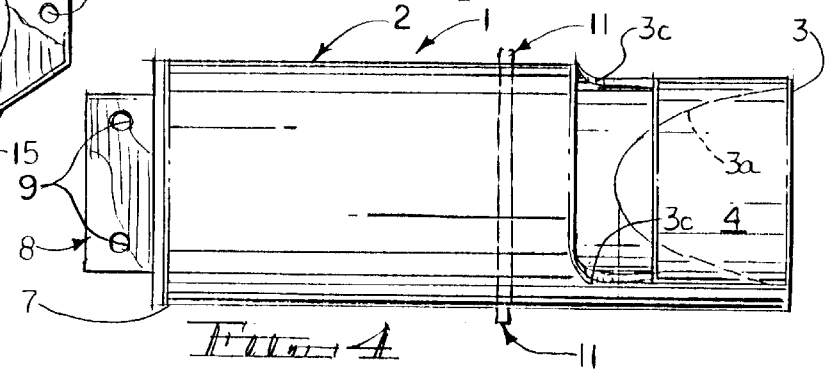
FIG. 4 is a top view of the solenoid selector switch shield illustrated in FIGS. 1–3.

As illustrated in FIGS. 1–3 of the drawing a bottom bracket 11 extends from approximately the midpoint of the shield barrel 2 and is characterized by a bracket radius 12, relief openings 13 for accommodating the feeder assembly bolts 21, and a central opening 14 for additional feeder assembly access purposes. A flat base 15 truncates a portion of the bottom periphery of the bottom bracket 11, as further illustrated in FIGS. 1 and 3. A barrel seat 16 engages the curvature of the shield barrel 2 and in a preferred embodiment of the invention the bottom bracket 11 is welded to the shield barrel 2 at the barrel seat 16, according to the knowledge of those skilled in the art.

As further illustrated in FIGS. 1 and 2, in a most preferred embodiment of the invention the access end 3 of the shield barrel 2 is characterized by an access end slot 3*b*, having a slot radius 3*c*, for accommodating one or more components of the feeder assembly 20 when the solenoid selector switch shield 1 is bolted to the feeder assembly 20 by the mount end bracket 8 and the bottom bracket 11, using fasteners such as cap screws or bolts (not illustrated), extended through the respective mount openings 9 in the mount end bracket 8 and bottom bracket 11, respectively. Furthermore, it will be appreciated from a consideration of FIG. 1 of the drawing that under circumstances where the solenoid selector switch shield 1 is mounted as indicated on the feeder assembly 20, the solenoid 18 is substantially enclosed within a solid portion of the shield barrel 2, while the selector switch 19 extends forwardly from the solenoid 18 and terminates in the selector switch knob 19*a*. Accordingly, the selector switch 19, including the selector switch knob 19*a* and the selector switch shaft 19*b*, are protected by the curved shaft plate 4, while allowing optimum access to the selector switch knob 19*a* through the access end 3 of the shield barrel 2 at the access end bevel 3*a*. This optimum access of the selector switch knob 19*a* is accommodated by the access end bevel 3*a* and the curvature of the shaft plate 4.

Referring again to the access end bevel 3*a* of the shield barrel 2 as illustrated in FIGS. 1 and 2, in a most preferred embodiment the access end bevel 3*a* describes an angle "A" of from about 15 degrees to about 25 degrees and most preferably, an angle "A" of about 20 degrees with respect to the datum line 22 that extends the shield barrel 2.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A solenoid selector switch shield for protecting a weapons system solenoid and solenoid selector switch, said shield comprising a generally cylindrically-shaped shield barrel for substantially encircling the solenoid and solenoid selector switch; a mount end terminating one end of said shield barrel and a bevelled access end provided on the opposite end of said shield barrel at the solenoid selector switch, for accessing the solenoid selector switch; and bracket means provided on said shield barrel for mounting said shield barrel on the weapons system.

2. The solenoid selector switch shield of claim 1 wherein said bevelled access end comprises a bevel describing an angle in the range of from about 15 degrees to about 25 degrees with respect to a datum plane extending longitudinally through said shield barrel.

3. The solenoid selector switch shield of claim 2 wherein said angle is about 20 degrees.

4. The solenoid selector switch shield of claim 1 wherein said bracket means comprises a first bracket provided on said mount end of said shield barrel and a second bracket provided on said shield barrel intermediate said mount end and said bevelled access end of said shield barrel.

5. The solenoid selector switch shield of claim 4 wherein said bevelled access end comprises a bevel describing an angle in the range of from about 15 degrees to about 25 degrees with respect to a datum plane extending longitudinally through said shield barrel.

6. The solenoid selector switch shield of claim 5 wherein said angle is about 20 degrees.

7. The solenoid selector switch shield of claim 4 comprising at least one opening provided in said second bracket for accommodating projecting elements of the weapons system when said solenoid selector switch shield is mounted on the weapons system.

8. The solenoid selector switch shield of claim 7 wherein said bevelled access end comprises a bevel describing an angle in the range of from about 15 degrees to about 25 degrees with respect to a datum plane extending longitudinally through said shield barrel.

9. The solenoid selector switch shield of claim 8 wherein said angle is about 20 degrees.

10. The solenoid selector switch shield of claim 1 comprising a slot provided in said bevelled access end of said shield barrel and a curved shaft plate spanning said slot for further protecting the solenoid selector switch.

11. The solenoid selector switch shield of claim 10 wherein said bevelled access end comprises a bevel describing an angle in the range of from about 15 degrees to about 25 degrees with respect to a datum plane extending longitudinally through said shield barrel.

12. The solenoid selector switch shield of claim 11 wherein said angle is about 20 degrees.

13. The solenoid selector switch shield of claim 10 wherein said bracket means comprises a first bracket provided on said mount end of said shield barrel and a second bracket provided on said shield barrel intermediate said mount end and said bevelled access end of said shield barrel.

14. The solenoid selector switch shield of claim 13 comprising at least one opening provided in said second bracket for accommodating projecting elements of the weapons system when said solenoid selector switch shield is mounted on the weapons system.

15. The solenoid selector switch shield of claim 14 wherein said bevelled access end comprises a bevel describing an angle in the range of from about 15 degrees to about 25 degrees with respect to a datum plane extending longitudinally through said shield barrel.

16. The solenoid selector switch shield of claim 15 wherein said angle is about 20 degrees.

* * * * *